US011787032B1

(12) United States Patent
Viens

(10) Patent No.: US 11,787,032 B1
(45) Date of Patent: Oct. 17, 2023

(54) MULTI-FUNCTION MARINE TOOL

(71) Applicant: Timothy Viens, Port Orange, FL (US)

(72) Inventor: Timothy Viens, Port Orange, FL (US)

( * ) Notice: Subject to any disclaimer, the term of this patent is extended or adjusted under 35 U.S.C. 154(b) by 401 days.

(21) Appl. No.: 17/000,793

(22) Filed: Aug. 24, 2020

Related U.S. Application Data

(60) Provisional application No. 62/890,966, filed on Aug. 23, 2019.

(51) Int. Cl.

| | |
|---|---|
| ***B25F 1/04*** | (2006.01) |
| ***B25B 13/50*** | (2006.01) |
| ***B25G 1/10*** | (2006.01) |
| ***G10K 5/00*** | (2006.01) |
| ***B67B 7/16*** | (2006.01) |
| ***B67B 7/44*** | (2006.01) |
| ***B67B 7/04*** | (2006.01) |
| ***B26B 11/00*** | (2006.01) |

(52) U.S. Cl.
CPC ..... *B25F 1/04* (2013.01); *B25B 13/50* (2013.01); *B25G 1/102* (2013.01); *B26B 11/00* (2013.01); *B67B 7/04* (2013.01); *B67B 7/16* (2013.01); *B67B 7/44* (2013.01); *G10K 5/00* (2013.01)

(58) Field of Classification Search
CPC ..... B25F 1/04; B25B 13/50; B25G 1/102; B26B 11/00; B67B 7/04; B67B 7/16; B67B 7/44; G10K 5/00
USPC ..... 7/138
See application file for complete search history.

(56) References Cited

U.S. PATENT DOCUMENTS

| | | | | |
|---|---|---|---|---|
| 1,034,383 | A * | 7/1912 | Bronson | B25B 13/102 81/177.85 |
| D156,354 | S * | 12/1949 | Belle | 81/177.85 |
| 4,672,745 | A * | 6/1987 | Wilkens | B25G 1/102 30/138 |
| 5,386,605 | A * | 2/1995 | Murphy | B25B 13/56 7/138 |
| 7,188,578 | B2 * | 3/2007 | DeRosa | B25B 13/48 49/35 |
| 7,313,983 | B1 * | 1/2008 | Book | B67B 7/16 81/3.55 |
| 2014/0082850 | A1 * | 3/2014 | Stokes | B25F 1/003 81/319 |

* cited by examiner

*Primary Examiner* — Hadi Shakeri
(74) *Attorney, Agent, or Firm* — Allen, Dyer, Doppelt & Gilchrist, P.A.

(57) ABSTRACT

A multi-function marine tool includes a shaft extending along a shaft axis between first and second shaft ends, and a T-handle connected to the second shaft end and extending along a handle axis between first and second handle end faces. Opposite handle lateral side faces and handle top and bottom side faces extend between the first and second handle end faces along the handle axis. A first wrench head is formed as a socket recessed into a shaft end face at the first shaft end, and second, third and fourth wrench heads, of different sizes, are each formed as a pair of protrusions extending outwardly from the first handle end face, second handle end face, and one of the handle lateral side faces, respectively. Additional accessories, including a bottle opener, corkscrew and cork puller and line cutter can be incorporated into the T-handle without increasing the dimensions thereof.

24 Claims, 6 Drawing Sheets

MULTI-FUNCTION MARINE TOOL

CROSS-REFERENCE TO RELATED APPLICATION

This application claims the benefit of U.S. Provisional Patent Application Ser. No. 62/890,966, filed on Aug. 23, 2019, the contents of which are herein incorporated by reference in their entirety.

FIELD OF THE INVENTION

The present invention relates to tools used on boats and other marine vessels, and more particularly, to marine tools incorporating more than one function.

BACKGROUND OF THE INVENTION

Boats and other marine vessels are commonly equipped with various threaded drain plugs, tank covers and the like. Often, each plug and cover requires a specialized tool to engage it for opening and closing. Keeping track of all these tools so that each is ready to hand when needed can be a challenge. While some multi-function tools have been developed effectively combining more than one wrench, such tools can be awkward to hold and use for one or more of their intended functions.

SUMMARY OF THE INVENTION

In view of the foregoing, it is an object of the present invention to provide an improved multi-function marine tool. According to an aspect of the present invention, a bottle opener opening is defined in the T-handle extending between the handle lateral side faces and a bottle opener extends into the bottle opener opening. According to another aspect, a corkscrew recess is defined extending into the top side face and a corkscrew and a cork puller are pivotably attached in the corkscrew recess. According to a further aspect, a line cutter notch is defined extending into the first handle end face between the first pair of protrusions and a line cutter extends into the line cutter notch. According to an additional aspect, the T-handle includes a metal plate embedded within plastic, the first and second pairs of protrusions, the bottle cutter, and the line cutter all being parts of the metal plate, the corkscrew and the cork puller being hingedly attached to the metal plate.

According to a method aspect, the first wrench head is applied to rotate a garboard drain plug, and the second, third and fourth wrench heads are applied to rotate respective deck plates.

These and other objects, aspects and advantages of the present invention will be better appreciated in view of the drawings and following detailed description of preferred embodiments.

Figure 3:
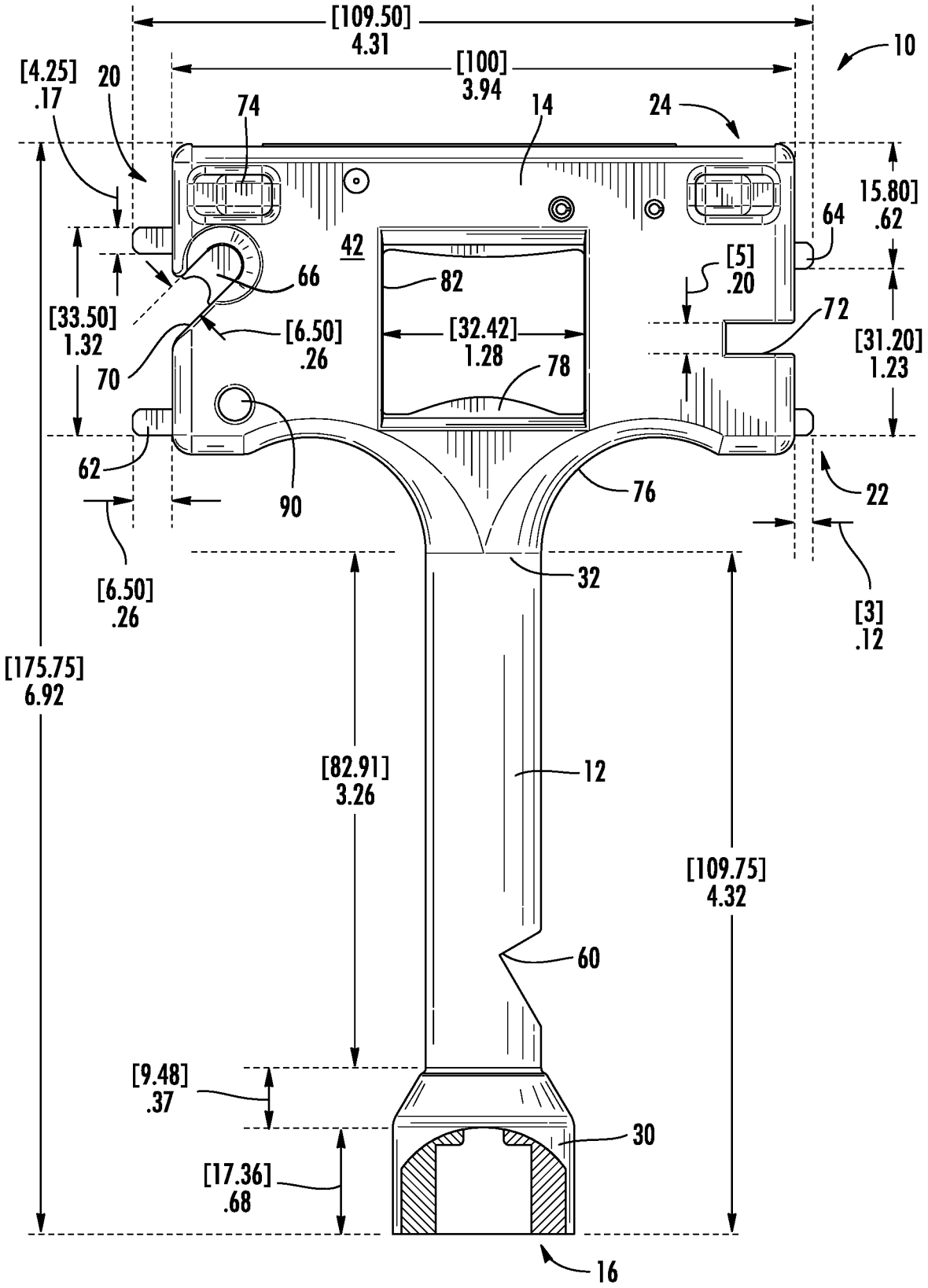
FIG. 3 is a side view of the tool of FIG. 1, with partial cutaway to show internal details.
Figure 4:
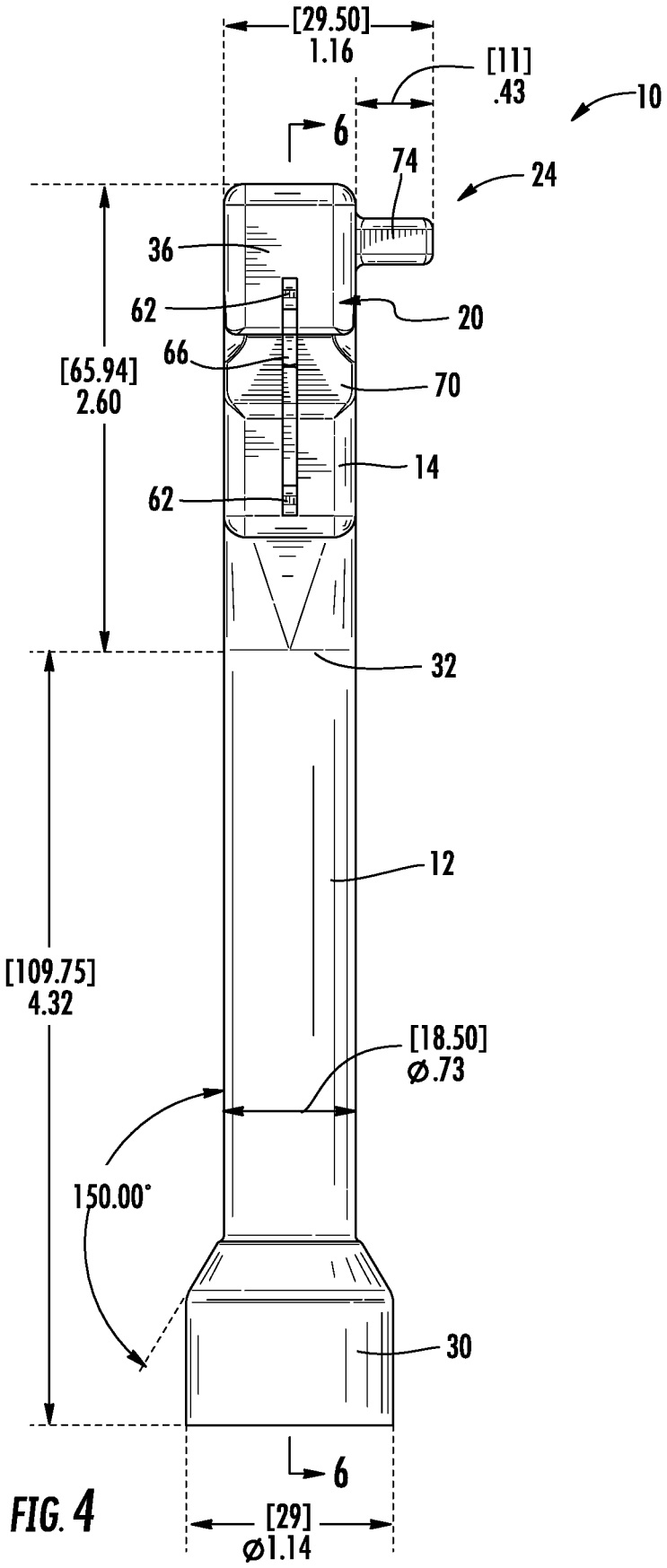
FIG. 4 is an end view of the tool of FIG. 1.
Figure 5:
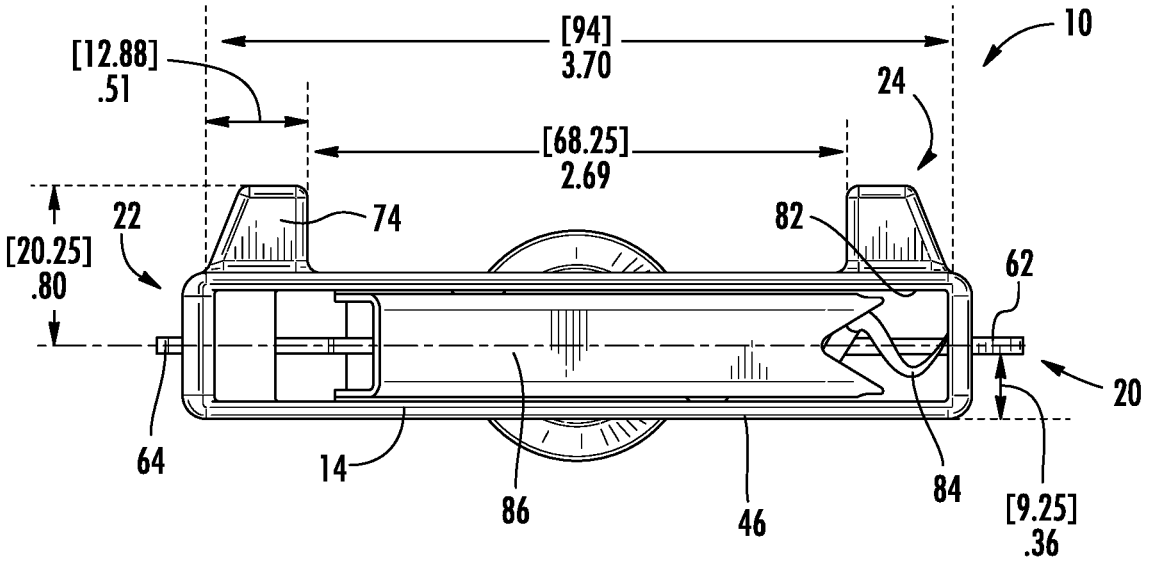
FIG. 5 is a top view of the tool of FIG. 1.

Dimensions indicated on FIGS. 3-5 are provided in inches and [millimeters]. The drawings are executed to scale, such that other dimensions can be derived from the dimensions provided.

DETAILED DESCRIPTION OF THE DRAWINGS

Figure 1:
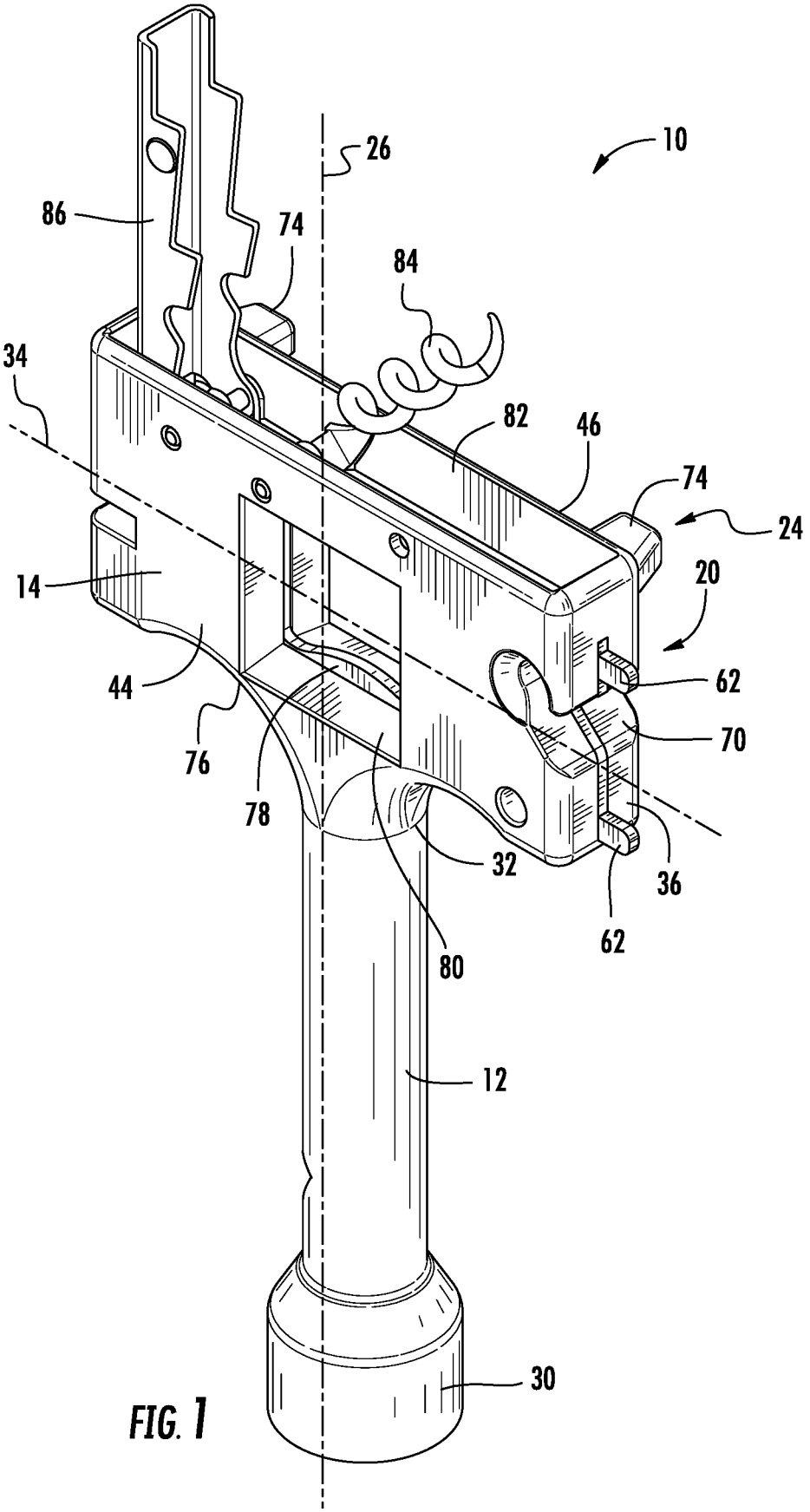
FIG. 1 is a perspective view of a multi-function marine tool, according to an embodiment of the present invention.
Figure 2:
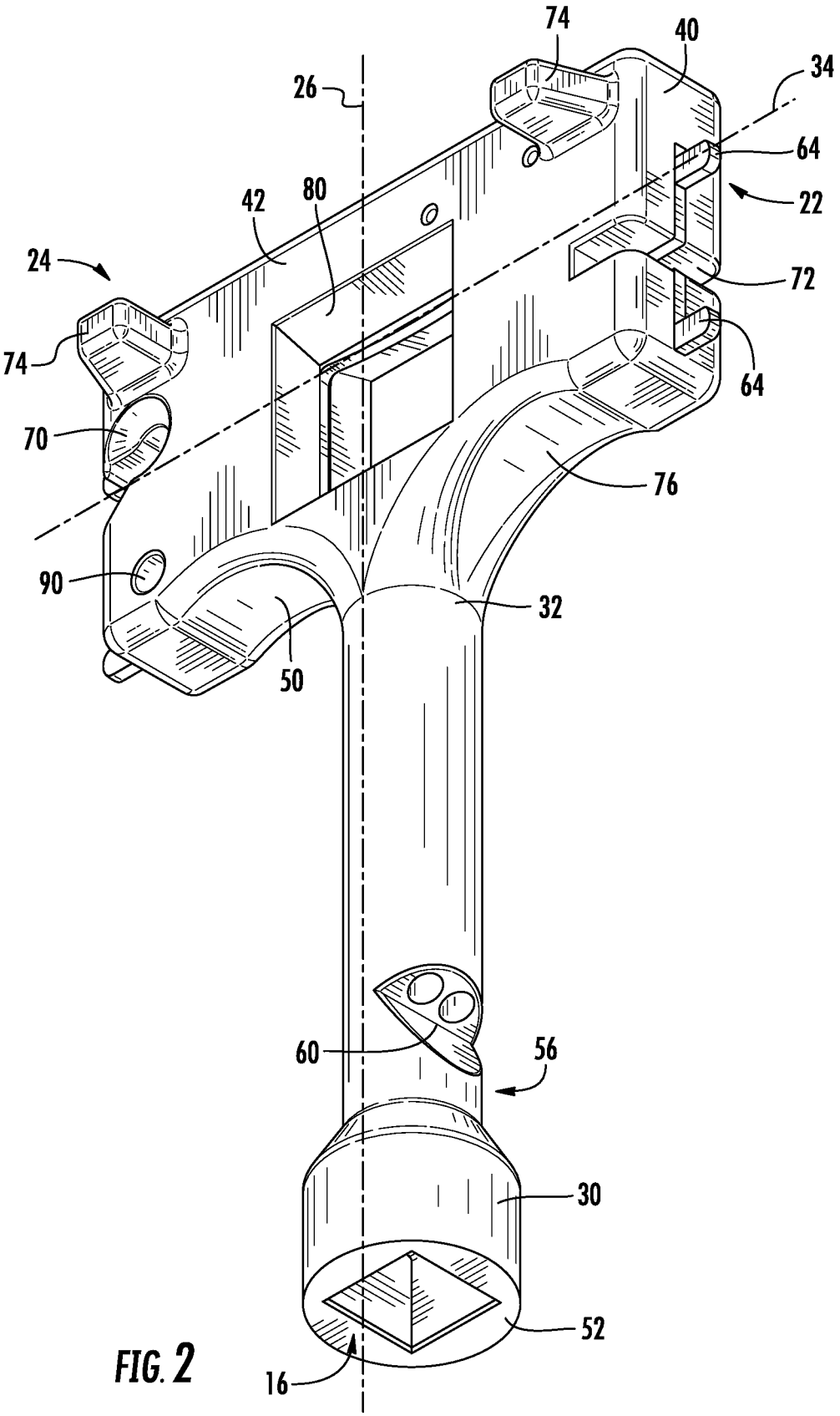
FIG. 2 is another perspective view of the tool of FIG. 1.

Referring to FIGS. 1 and 2 according to an embodiment of the present invention, a multi-function marine tool 10 includes a shaft 12 terminating in a T-handle 14. A plurality of wrench heads 16, 20, 22 and 24 are formed on the shaft 12 and the T-handle 14, each the of the wrench heads 16, 20, 22 and 24 being dimensioned to engage a different marine fitting.

The shaft 12 extends along a shaft axis 26 between first and second shaft ends 30, 32. The T-handle 14 connects to the second shaft end 32 and extends along a handle axis 34 between first and second handle end faces 36, 40. Handle sides faces 42-50 extend between the end faces 36, 40 along the handle axis 34.

Referring additionally to FIGS. 3-5, the wrench head 16 is a socket recessed into a shaft end face 52 at the first shaft end 26. Preferably, the socket 16 is a square socket dimensioned to closely engage a garboard drain plug. To add strength to the socket 16, a diameter of the shaft is increased at the first shaft end 30.

Figure 6:
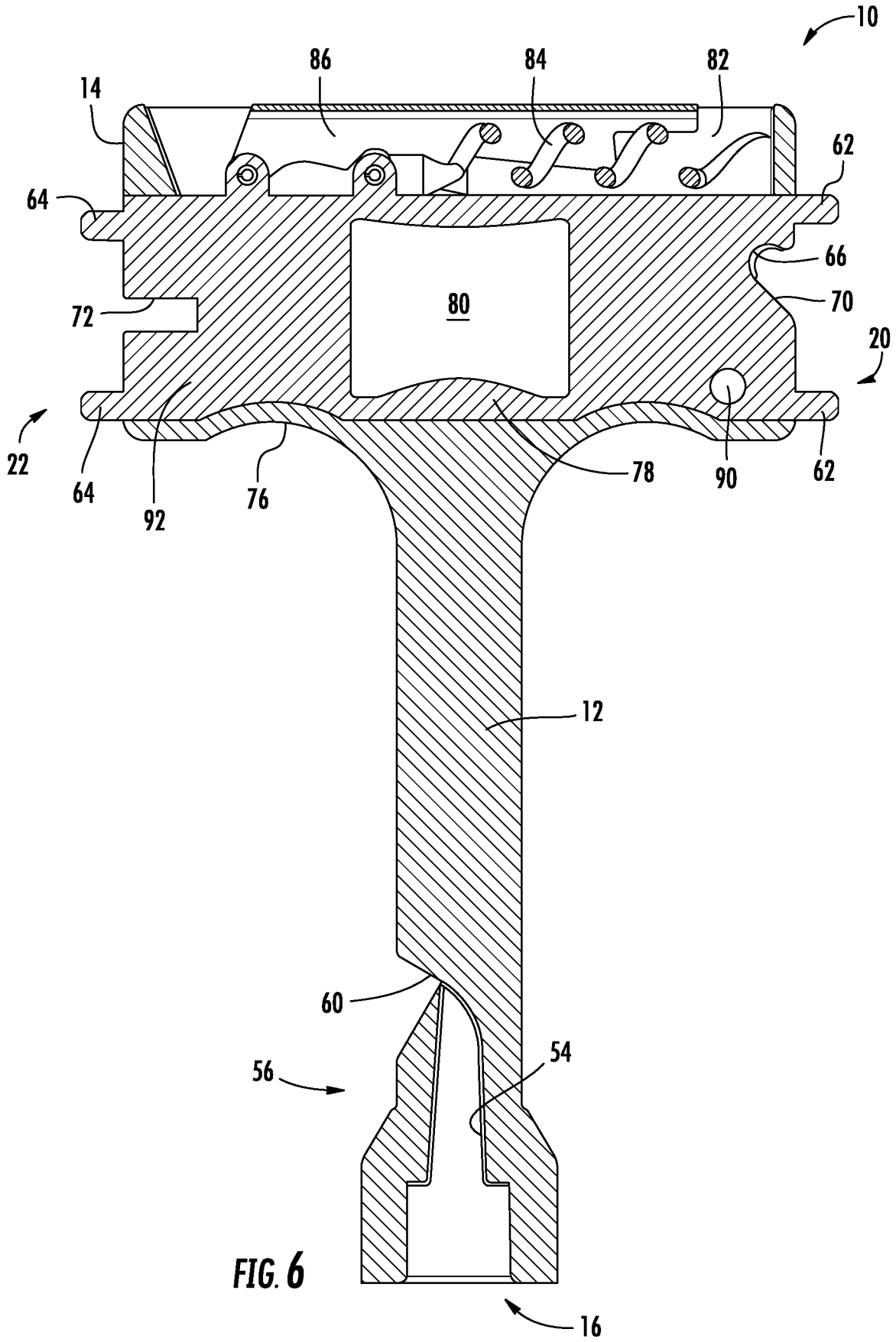
FIG. 6 is a sectional view of the tool of FIG. 1.

Referring also to FIG. 6, advantageously, the recess of the socket 16 continues into the shaft 12 with a decreasing diameter to form the windway 54 of a whistle 56. The windway 54 terminates at a whistle mouth 60 formed in a side of the shaft 12. Thus, by blowing into the socket 16, a user can sound the whistle 56.

The wrenches 20, 22 are located on the first and second handle end faces 36, 40, respectively. Preferably, each wrench 20, 22 is a deck plate key. The spacing between protrusions 62 of the first deck plate key 20 is different than the spacing between protrusions 64 of the second deck plate key 22, such that different fittings are engageable by each. Fittings generally engageable by the deck plate keys 20, 22 include gas and waste tank covers.

A line cutter 66 is located in a first notch 70 extending into the T-handle 14 from the first handle end face 36 between the protrusions 62 of the first deck plate key 20. A second notch 72 extending into the T-handle 14 from the second handle end face 40 between the protrusions 64 of the second deck plate key 22 serves as a line collector.

The wrench 24 is a third deck plate key formed by a pair of protrusions 74 extending from a lateral face 42 of the side faces 42-50. "Lateral" as applied to the side faces 42-50 of the T-handle 14 indicates a side face other than the top face 46 or bottom face 50. The shaft axis 26 does not intersect the lateral side faces 42, 44, but does intersect the top and bottom faces 46, 50. The spacing between the protrusions 74 is larger than that between the protrusions 62 or protrusions 64, allowing engagement with larger deck plates, such as inspection hatch covers.

Significantly, the placement of the socket 16 on the shaft end face 52 allows the T-handle 14 to be grasped to apply torque when engaging fittings with the socket 16. When engaging fittings with any of the deck keys 20-24, the shaft 12 can be grasped to apply torque. Finger grooves 76 are formed in the bottom side face 50 of the T-handle 14 to facilitate grasping.

To further increase the utility of the tool 10, a bottle opener 78 is located on the T-handle 14 in an opening 80 extending between the lateral side faces 42, 44. The width of the T-handle 14 between the lateral side faces 42, 44 is advantageously sufficient to allow a recess 82 to be formed extending into the top side face 46, in which a corkscrew 84 and cork puller 86 are pivotably mounted. A lanyard opening 90 extends between the lateral sides faces 42, 44.

The tool 10 is preferably primarily formed from molded plastic having suitable strength and durability properties. Additionally, a plastic can be selected which will ensure the tool is positively buoyant so as to float if inadvertently dropped into the water by a user. To afford additional strength, the protrusions 62, 64 of the first and second deck keys 20, 22 can be formed on a metal plate 92 extending through and embedded within the otherwise molded T-handle 14. The line cutter 66 and bottle opener 78 are also formed as part of the plate 92. Likewise, the corkscrew 84 and cork puller 86 hingedly attach to the plate 92.

It will be appreciated from the foregoing that the multi-function marine tool 10 according to the present invention integrates the functionality of four different wrenches into a single tool that remains relatively compact and easy to grasp and operate. Up to six additional tools of use to the recreational boater, fisherman or other mariner are further incorporated into the tool 10 without increasing its size or detracting from its ease of use.

In general, the foregoing description is provided for exemplary and illustrative purposes; the present invention is not necessarily limited thereto. Rather, those skilled in the art will appreciate that additional modifications, as well as adaptations for particular circumstances, will fall within the scope of the invention as herein shown and described and of the claims appended hereto.

What is claimed is:

1. A multi-function marine tool comprising:

a shaft extending along a shaft axis between first and second shaft ends; and a T-handle connected to the second shaft end and extending along a handle axis between first and second handle end faces, the handle axis intersecting the shaft axis, opposite handle lateral side faces and opposite handle top and bottom side faces extending between the first and second handle end faces along the handle axis, the shaft axis intersecting the handle top and bottom side faces;

wherein a first wrench head is formed as a socket recessed into a shaft end face at the first shaft end extending along the shaft axis, a second wrench head is formed as a first pair of protrusions extending outwardly from the first handle end face with a first spacing, a third wrench head is formed as a second pair of protrusions extending outwardly from the second handle end face with a second spacing, and a fourth wrench head is formed as a third pair of protrusions extending outwardly from one of the handle lateral side faces with a third spacing, the first, second and third spacings being different; and wherein a recess of the socket continues into the shaft with a decreasing diameter to form a windway of a whistle terminating at a whistle mouth formed in a side of the shaft between the first and second shaft ends.

2. The multi-function marine tool of claim 1, wherein the socket is a square socket dimensioned to engage a garboard drain plug.

3. The multi-function marine tool of claim 2, wherein a shaft diameter is increased at the first shaft end around the square socket.

4. The multi-function marine tool of claim 1, wherein the T-handle includes a metal plate embedded within plastic, the first and second pairs of protrusions both being parts of the metal plate.

5. The multi-function marine tool of claim 4, wherein the shaft is also formed from plastic, co-molded with the plastic of the T-handle.

6. The multi-function marine tool of claim 5, wherein the multi-function marine tool is positively buoyant.

7. The multi-function marine tool of claim 4, wherein a bottle opener opening is defined in the T-handle extending between the handle lateral side faces, a bottle opener formed as another part of the metal plate extending into the bottle opener opening.

8. The multi-function marine tool of claim 4, wherein a corkscrew recess is defined extending into the top side face, a corkscrew and a cork puller being accommodated in the corkscrew recess and hingedly attached to the metal plate.

9. The multi-function marine tool of claim 4, wherein a line cutter notch is defined extending into the first handle end face between the first pair of protrusions, a line cutter formed as another part of the metal plate extending into the line cutter notch.

10. The multi-function marine tool of claim 9, wherein a line collector notch is defined extending into the second handle end face between the second pair of protrusions.

11. The multi-function marine tool of claim 4, wherein a bottle opener opening is defined in the T-handle extending between the handle lateral side faces, a bottle opener formed as another part of the metal plate extending into the bottle opener opening;

wherein a corkscrew recess is defined extending into the top side face, a corkscrew and a cork puller being accommodated in the corkscrew recess and hingedly attached to the metal plate; and wherein a line cutter notch is defined extending into the first handle end face between the first pair of protrusions, a line cutter formed as another part of the metal plate extending into the line cutter notch.

12. The multi-function marine tool of claim 1, wherein finger grooves are formed in the handle bottom side face.

13. The multi-function marine tool of claim 1, wherein a width of the socket is 15.5 millimeters (mm), the first spacing is 33.5 mm between outer edges of the first pair of protrusions, the second spacing is 31.2 mm between outer edges of the second pair of protrusions and the third spacing is 94 mm between outer edges of the third pair of protrusions.

14. The multi-function marine tool of claim 13, wherein thickness of the T-handle between the opposite handle lateral side faces is 11 mm.

15. A method of using the multi-function marine tool of claim 1, the method comprising:

applying the first wrench head to rotate a garboard drain plug; and applying the second, third and fourth wrench heads to rotate respective deck plates.

16. A multi-function marine tool comprising:

a shaft extending along a shaft axis between first and second shaft ends; and a T-handle connected to the second shaft end and extending along a handle axis between first and second handle end faces, the handle axis intersecting the shaft axis, opposite handle lateral side faces and opposite handle top and bottom side faces extending between the first and second handle end faces along the handle axis, the shaft axis intersecting the handle top and bottom side faces;

wherein a first wrench head is formed as a socket recessed into a shaft end face at the first shaft end extending along the shaft axis, a second wrench head is formed as a first pair of protrusions extending outwardly from the first handle end face with a first spacing, a third wrench head is formed as a second pair of protrusions extending outwardly from the second handle end face with a second spacing, and a fourth wrench head is formed as a third pair of protrusions extending outwardly from one of the handle lateral side faces with a third spacing, the first, second and third spacings being different;

wherein a bottle opener opening is defined in the T-handle extending between the handle lateral side faces and a bottle opener extends into the bottle opener opening;

wherein a corkscrew recess is defined extending into the top side face and a corkscrew and a cork puller are pivotably attached in the corkscrew recess; and wherein a line cutter notch is defined extending into the first handle end face between the first pair of protrusions and a line cutter extends into the line cutter notch.

17. The multi-function marine tool of claim 16, wherein the T-handle includes a metal plate embedded within plastic, the first and second pairs of protrusions, the bottle cutter, and the line cutter all being parts of the metal plate, the corkscrew and the cork puller being hingedly attached to the metal plate.

18. The multi-function marine tool of claim 17, wherein the shaft is also formed from plastic, co-molded with the plastic of the T-handle.

19. The multi-function marine tool of claim 18, wherein a recess of the socket continues into the shaft with a decreasing diameter to form a windway of a whistle terminating at a whistle mouth formed in a side of the shaft between the first and second shaft ends.

20. A multi-function marine tool comprising:

a shaft extending along a shaft axis between first and second shaft ends; and a T-handle connected to the second shaft end and extending along a handle axis between first and second handle end faces, the handle axis intersecting the shaft axis, opposite handle lateral side faces and opposite handle top and bottom side faces extending between the first and second handle end faces along the handle axis, the shaft axis intersecting the handle top and bottom side faces;

wherein a first wrench head is formed as a socket recessed into a shaft end face at the first shaft end extending along the shaft axis, a second wrench head is formed as a first pair of protrusions extending outwardly from the first handle end face with a first spacing, a third wrench head is formed as a second pair of protrusions extending outwardly from the second handle end face with a second spacing, and a fourth wrench head is formed as a third pair of protrusions extending outwardly from one of the handle lateral side faces with a third spacing, the first, second and third spacings being different;

wherein the T-handle includes a metal plate embedded within plastic, the first and second pairs of protrusions both being parts of the metal plate; and wherein a bottle opener opening is defined in the T-handle extending between the handle lateral side faces, a bottle opener formed as another part of the metal plate extending into the bottle opener opening.

21. A multi-function marine tool comprising:

a shaft extending along a shaft axis between first and second shaft ends; and a T-handle connected to the second shaft end and extending along a handle axis between first and second handle end faces, the handle axis intersecting the shaft axis, opposite handle lateral side faces and opposite handle top and bottom side faces extending between the first and second handle end faces along the handle axis, the shaft axis intersecting the handle top and bottom side faces;

wherein a first wrench head is formed as a socket recessed into a shaft end face at the first shaft end extending along the shaft axis, a second wrench head is formed as a first pair of protrusions extending outwardly from the first handle end face with a first spacing, a third wrench head is formed as a second pair of protrusions extending outwardly from the second handle end face with a second spacing, and a fourth wrench head is formed as a third pair of protrusions extending outwardly from one of the handle lateral side faces with a third spacing, the first, second and third spacings being different;

wherein the T-handle includes a metal plate embedded within plastic, the first and second pairs of protrusions both being parts of the metal plate; and wherein a corkscrew recess is defined extending into the top side face, a corkscrew and a cork puller being accommodated in the corkscrew recess and hingedly attached to the metal plate.

22. A multi-function marine tool comprising:

a shaft extending along a shaft axis between first and second shaft ends; and a T-handle connected to the second shaft end and extending along a handle axis between first and second handle end faces, the handle axis intersecting the shaft axis, opposite handle lateral side faces and opposite handle top and bottom side faces extending between the first and second handle end faces along the handle axis, the shaft axis intersecting the handle top and bottom side faces;

wherein a first wrench head is formed as a socket recessed into a shaft end face at the first shaft end extending along the shaft axis, a second wrench head is formed as a first pair of protrusions extending outwardly from the first handle end face with a first spacing, a third wrench head is formed as a second pair of protrusions extending outwardly from the second handle end face with a second spacing, and a fourth wrench head is formed as a third pair of protrusions extending outwardly from one of the handle lateral side faces with a third spacing, the first, second and third spacings being different;

wherein the T-handle includes a metal plate embedded within plastic, the first and second pairs of protrusions both being parts of the metal plate; and wherein a line cutter notch is defined extending into the first handle end face between the first pair of protrusions, a line cutter formed as another part of the metal plate extending into the line cutter notch.

23. The multi-function marine tool of claim 22, wherein a line collector notch is defined extending into the second handle end face between the second pair of protrusions.

24. A multi-function marine tool comprising:

a shaft extending along a shaft axis between first and second shaft ends; and a T-handle connected to the second shaft end and extending along a handle axis between first and second handle end faces, the handle axis intersecting the shaft axis, opposite handle lateral side faces and opposite handle top and bottom side faces extending between the first and second handle end faces along the handle axis, the shaft axis intersecting the handle top and bottom side faces;

wherein a first wrench head is formed as a socket recessed into a shaft end face at the first shaft end extending along the shaft axis, a second wrench head is formed as a first pair of protrusions extending outwardly from the first handle end face with a first spacing, a third wrench head is formed as a second pair of protrusions extending outwardly from the second handle end face with a second spacing, and a fourth wrench head is formed as a third pair of protrusions extending outwardly from one of the handle lateral side faces with a third spacing, the first, second and third spacings being different;

wherein a width of the socket is 15.5 millimeters (mm), the first spacing is 33.5 mm between outer edges of the first pair of protrusions, the second spacing is 31.2 mm between outer edges of the second pair of protrusions and the third spacing is 94 mm between outer edges of the third pair of protrusions; and wherein thickness of the T-handle between the opposite handle lateral side faces is 11 mm.

* * * * *